US007225658B2

(12) United States Patent
Hakansson

(10) Patent No.: US 7,225,658 B2
(45) Date of Patent: Jun. 5, 2007

(54) METHOD FOR MANUFACTURE OF A METAL SHELL, AND A CUP DESIGNED TO SERVE AS A BLANK

(75) Inventor: Lennart Hakansson, deceased, late of Kil (SE); by Lilian Hakansson, legal representative, Kil (SE)

(73) Assignee: Zakrisdalsverken Aktiebolag, Karlstad (SE)

( * ) Notice: Subject to any disclaimer, the term of this patent is extended or adjusted under 35 U.S.C. 154(b) by 0 days.

(21) Appl. No.: 10/521,165

(22) PCT Filed: Jul. 3, 2003

(86) PCT No.: PCT/SE03/01156

§ 371 (c)(1),
(2), (4) Date: Sep. 7, 2005

(87) PCT Pub. No.: WO2004/009267

PCT Pub. Date: Jan. 29, 2004

(65) Prior Publication Data

US 2006/0112751 A1 Jun. 1, 2006

(30) Foreign Application Priority Data

Jul. 23, 2002 (SE) ..... 0202293
Sep. 16, 2002 (SE) ..... 0202766

(51) Int. Cl.
*B21C 23/18* (2006.01)

(52) U.S. Cl. ..... 72/267; 72/256; 72/264

(58) Field of Classification Search ..... 72/256, 72/264, 266, 267, 347, 348, 370.14
See application file for complete search history.

(56) References Cited

U.S. PATENT DOCUMENTS 2,264,266 A 11/1941 Jacobs
3,507,140 A * 4/1970 Tassaro ..... 72/327
3,706,118 A 12/1972 Hilton (Continued)

OTHER PUBLICATIONS

Database WPI, Week 198228, Derwent Publictions Ltd., London, GB; AN 1982-58034E & JP 57089466 A (Mitsubishi Keinkinzoku Kogyo) Jun. 3, 1982.

*Primary Examiner*—Ed Tolan
(74) *Attorney, Agent, or Firm*—Jeffrey S. Melcher; Manelli Denison & Selter, PLLC

(57) ABSTRACT

The invention relates to manufacture of a cup (1) that is designed to serve as a blank in the production of a metal shell (2) by providing a body (3) of a bar material, placing the body (3) in a counterdie (6) in which a first end surface of the body (3), which is substantially perpendicular to the central axis (C) of the body, is placed facing towards the bottom of the counterdie while the inner wall of the counterdie (6) encloses at least a part of the body and preferably the whole body, so that the body (3) is hereby placed in the counterdie (6), applying a mandrel (9) to a second end surface of the body that is substantially perpendicular to the central axis C of the body (3), applying a pressing force to the mandrel (9) so that the body (3) is cold flow pressed through plastic deformation into a cup (1). The invention also relates to an application of a body for manufacture of a blank for a grenade/cartridge shell and a process for manufacture of a grenade/cartridge shell.

25 Claims, 4 Drawing Sheets

U.S. PATENT DOCUMENTS 4,200,051 A * 4/1980 Nakahara et al. ..... 72/283
4,321,816 A * 3/1982 Nakahara et al. ..... 72/267
4,570,843 A 2/1986 Matsuzaki et al.
5,042,283 A * 8/1991 Nishida ..... 72/267

* cited by examiner

Fig. 1A
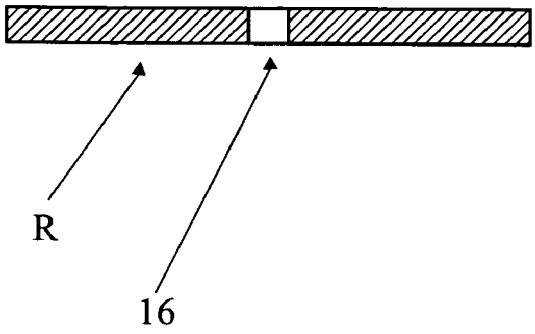
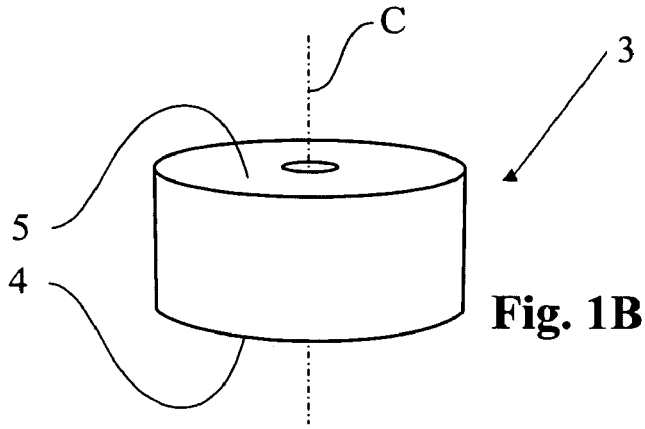
Fig. 1B
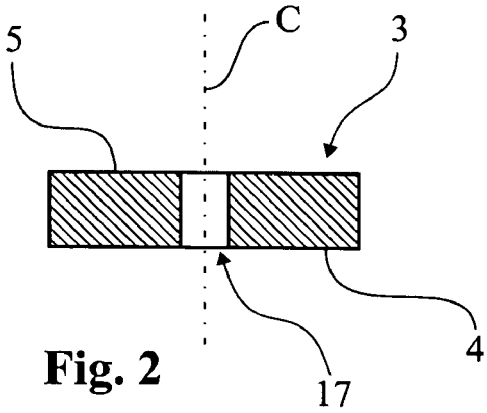
Fig. 2

2

2

22
$d_A$
A
20
31

2

2

METHOD FOR MANUFACTURE OF A METAL SHELL, AND A CUP DESIGNED TO SERVE AS A BLANK

This application is a 35 USC 371 of PCT/SE03/01156 filed Jul. 3, 2003.

TECHNICAL FIELD

The present invention relates to a method for manufacture of a metal shell in a steel, aluminium or copper alloy. The invention also relates to a method for manufacture of a cup designed to serve as a blank.

PRIOR ART

Forming of metals can take place both in a warm and a cold state. The present invention relates to forming through a specific method called cold forging. Cold forging can be divided into three main types, cold flow pressing, deep drawing and upsetting.

Cold forging refers to a method of forming at a temperature that lies below the recrystallization temperature of the material. Cold forging has a number of advantages compared with other methods of forming, some of the advantages being forming of complicated shapes, a reduction in material wastage and good surface smoothness without the need for subsequent working. Cold forging also offers the opportunity to influence the metal's grain structure, size and orientation in a unique way. This gives improved electrical and mechanical properties, improved hardenability and improved hardness through deformation hardening.

For cold working of a metal, it is necessary for it to have specific properties including good ductility. Carbon steel, low alloy steel, specific aluminium alloys, brass and bronze are metals with these properties. Apart from adding various alloying metals to the metal, desirable properties are obtained by transformations of the structure of the material due to heat treatment among other things.

An example is given in JP57089466 of how it is said to be possible to achieve good cold working properties by alloying aluminium with 1.0–3.0 percent by weight Mn and up to 0.3 percent by weight Fe and directly following casting into a billet, i.e. a bar of slender dimensions, in this case with a diameter of 155 mm, quenching the material to thereby obtain magnesium in solid solution in the material. This billet is cut into pieces, which are then cold flow pressed to the desired shape and it is stated that the product obtained has good strength properties without any heat treatment being required.

The manufacture of metal shells, and in particular of shells for use in cartridge production, currently takes place from a blank consisting of a round, i.e. a thin circular disk cut out of cold-rolled sheet in a suitable material quality, for example SSEN 6082 (European standard), which is specially alloyed aluminium. Another suitable material can be brass. The round is shaped in a preliminary production stage by means of deep drawing and turning to form a cup that is then washed, annealed and pickled, following which it is worked further including by means of further deep drawing to give a finished shell. To manufacture cartridge shells, a round of this kind can have a thickness of around 10 mm and a diameter of approx. 160 mm.

For the round to withstand the load caused by subsequent deep drawing to form a finished shell, the material is required to a have a degree of reduction of at least 30% from the cold rolling. Cold rolling gives a characteristic structure of the material consisting of grain stretched in the direction of rolling, which gives desired strength properties through deformation hardening.

An example of the prior art for the manufacture of shells is shown in U.S. Pat. No. 2,264,266.

In the manufacture of a shell from this round that is of immediate interest to the invention, however, the grain structure of the material brings the disadvantage that the material flows with varying ease in different directions. During deep drawing, the material will move in the directions in which it flows most easily, i.e. where the resistance to deformation is lowest, and the result is that the material will not be distributed entirely evenly when the wall is formed. This results in the formation of characteristic so-called drawing lugs in the top edge of the cup, for which reason the cup has to be turned so that an even top edge is obtained. The method does not offer any opportunity either to obtain a certain thickness of the cup's bottom and walls in a controlled manner, resulting in disadvantages in subsequent production stages.

BRIEF DESCRIPTION OF THE INVENTION

The invention relates to a method for manufacture of a cup that is designed to serve as a blank in the production of a metal shell in an aluminium or copper alloy, for example, especially aluminium in a grade termed SSEN 6082. The invention is particularly well suited to the manufacture of blanks designed to be used in the production of shells with through holes, for example grenade or cartridge shells. The blank for the cup is obtained by cutting from a standardized bar material of suitable dimensions to give a body of suitable length. The bar material can be pressed, drawn or rolled bar with a circular, square, rectangular, hexagonal or other cross-section. To manufacture a cartridge shell, a bar with a circular cross-section is best used, so that a circular-cylindrical body is obtained on cutting. The body is characterized in that it is solid and has two end surfaces that are substantially parallel to one another and has a substantial extension in all planes, i.e. an extension vertically, laterally and longitudinally. The ratio between the largest and the smallest dimension can lie in this case in a range between 1:1–5:1. The body is turned if necessary to the exact diameter. The body is annealed and a lubricant applied, following which the body is cold flow pressed to give a cup.

In cold flow pressing, a surrounding wall is formed that is deformed uniformly, so that the upper open end of the cup acquires a substantially even edge that does not need to be turned. The cup is then washed, annealed again and pickled in order to undergo deep drawing to form a shell in the next production stage. The shell is cut off at the top edge to the desired length and the bottom flanged to the desired shape, following which the remaining material in the bottom of the shell is cut out. Finally the shell is solution heat treated, artificially aged and turned before it is surface finished and given a final inspection for delivery to the customer.

Due to the initial cold flow pressing, the bottom thickness of the cup can easily be varied as it is determined as a function of the quantity of material required for the flanging. When a round is used, the cup's bottom thickness cannot be varied, as the cup is formed by deep drawing of the round, which deep drawing is not designed to reduce the bottom thickness. On the other hand, it occurs that the bottom thickness is reduced unintentionally owing to the grain structure of the material, which gives rise to disadvantages in production.

It has also proved to be the case that the use of a round results in unnecessary wear on the flanging tools. The wear is caused by the flanging tools having to be compressed more than is desirable as the quantity of material remaining in the bottom of the shell is sometimes very little. This results in very high temperatures in the remaining material in the bottom of the shell, which increases the wear on the tools.

The reason that there is sometimes too little material is that the cold-rolled material structure in the round does not flow equally easily in all directions, which is why it is difficult to control the thickness. According to the present invention, the wear on the flanging tools as a result of such overheating can be avoided or minimized by adjusting the bottom thickness of the cup depending on the quantity of material required for flanging in the preliminary cold flow pressing.

The invention also has cost advantages. By using a bar material that is cut into the correct lengths, the consumption of raw material is minimized in the sense that no wastage or very little wastage occurs compared with manufacturing shells from rounds, in which the rounds are cut out of cold-rolled sheet, resulting in large amounts of waste. This means that the rounds are comparatively expensive to purchase. The fact that the forming of the cup can be done in an ordinary press of a standard type by simply exchanging tools also makes production cheaper. Due to cold flow pressing the cup acquires such material properties as well as such dimensional accuracy that it can be deep drawn to a finished shell without any intermediate working, which offers cost advantages. The reduced wear on the tools in flanging offers a further cost advantage.

OBJECT OF THE INVENTION

One object of the invention is to offer a method of manufacture of a metal shell in which the material has improved flow properties in the preliminary forming of a blank into a cup. Another object of the invention is to determine the thickness of the cup's bottom and wall easily and also in a more controlled manner. A further object is to offer a more flexible and cost-effective production process.

DESCRIPTION OF FIGURES

FIG. 1A shows a cross-section of around from a sheet material;

FIG. 1B shows a cross-section of a body from a bar material;

FIG. 2 shows a cross-section of a body that has been turned to size and provided with a drilled hole in the centre;

DETAILED DESCRIPTION

Figure 3A:
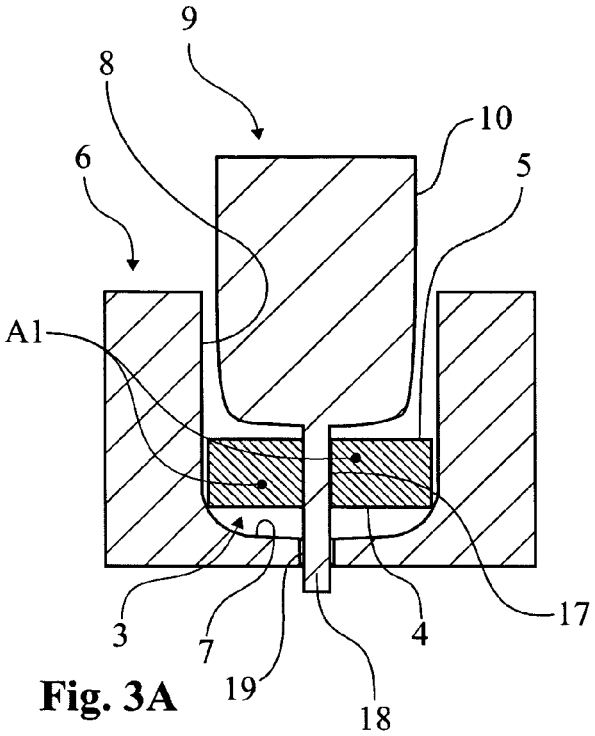
FIGS. 3A–3C show diagrammatically cold flow pressing of a body to form a cup.

The invention is to be described in greater detail with reference to the enclosed figures, which show the various manufacturing stages for a shell that constitutes an example of a suitable product according to the invention and can also be said to show a preferred embodiment The finished shell has a diameter of 10–500 mm, preferably 30–350 mm and even more preferredly 50–200 mm and a height of 50–3000 mm, preferably 50–2000 mm and even more preferredly 100–1000 mm, and has a minimum wall thickness in the mouth of the shell of 0.5–3.0 mm, preferably 1.2–2.0 mm and even more preferredly 1.3–1.7 mm. However, the invention is not restricted to the manufacture of shells but is also suitable for the production of other objects that are to be cold flow pressed and deep drawn, for example cylinders. Depending on the size of the products manufactured, the tools and machines are adapted to withstand the load that the various production stages entail.

The manufacture of a deep-drawn metal shell 2 takes place today from a blank in the form of a round R from a cold-rolled sheet. The round R is relatively thin in relation to its diameter. When producing a metal shell according to the invention, one starts instead from a body 3 cut from a bar material. The body 3 is cold flow pressed to give a cup 1, which is shaped into a shell 2 by deep drawing and worked further to the desired shape. The body 3 has a substantial extension in all dimensions.

FIG. 1A shows a cross-section of the round R, which according to a method currently used in Sweden forms a blank in the manufacture of a deep-drawn metal shell. The round R is in the form of a circular disk that is cut out of a cold-rolled sheet with a degree of deformation of at least 30%. The degree of deformation is essential, as it gives the material the necessary strength properties to withstand the load that plastic working brings about during the manufacturing process.

The dimensions of the round R are determined by the quantity of material required for production and it is essential that the round has a suitable thickness which, in the preliminary process stage when the round is formed into a cup by deep drawing, gives the cup its bottom thickness. The round R is provided with a drilled hole 16 in the centre and its edges are deburred, following which it is annealed and pickled. The purpose of the hole 16 is to drain away liquid during pickling.

FIG. 1B shows a side view of a body 3 that forms a blank in the manufacture of a shell according to the invention. The body 3 is obtained by cutting a bar material of a suitable dimension to a suitable length. The bar material is cut so that the section surfaces 4, 5 of the body 3 are substantially parallel to one another and substantially at right angles to the central axis C of the bar. If necessary the body 3 is turned all round to the exact dimensions. The body 3 has a width or diameter of 10–500 mm, preferably 30–350 mm and even more preferredly 50–200 mm and a height of 5–300 mm, preferably 10–100 and even more preferredly 20–50 mm. The section surfaces 4, 5 of the body 3 are its end surfaces and height refers to the distance between its two end surfaces 4, 5. In a preferred embodiment, the cup 3 is circular-cylindical but it can also have a different shape, for example a shape with a square cross-section.

FIG. 2 shows a cross-section of a body 3 that has been turned to the exact dimensions and provided with a hole 17 in the centre, for example a drilled hole. In this case the hole 17 serves two purposes, on the one hand to drain away the pickling liquid, but also to centre the body 3 in interaction with a mandrel 9 (see FIG. 3A) during cold flow pressing so that the quantity of material is distributed symmetrically, which gives better accuracy of the wall thickness.

Figure 3B:
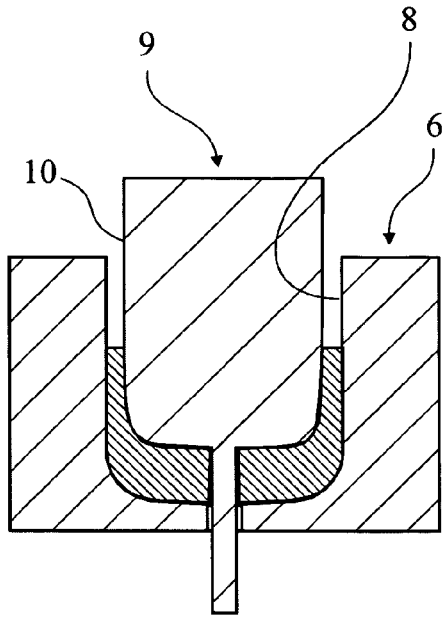
Figure 3C:
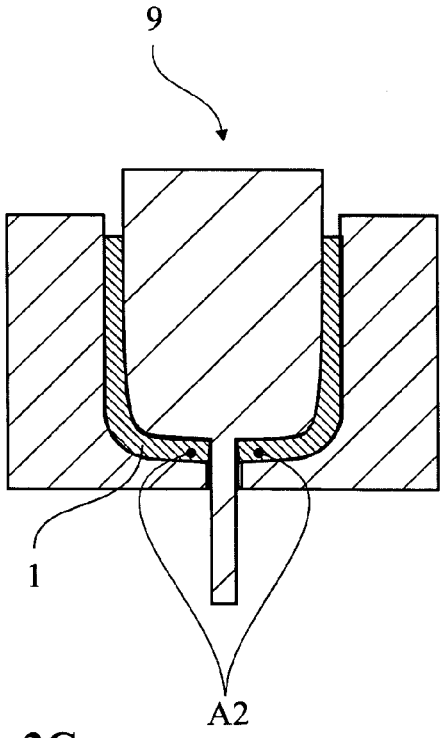
Figure 3D:
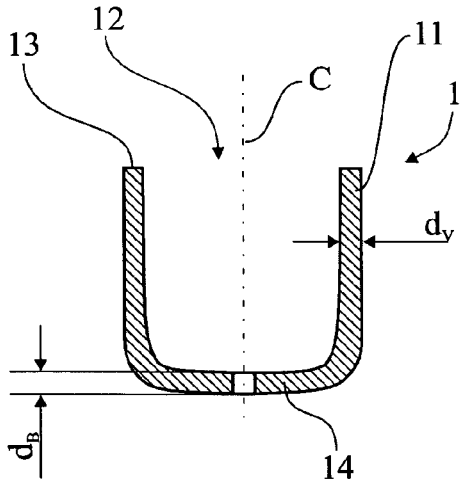
FIG. 3D shows a cross-section of a cup that has been obtained by cold flow pressing of a body.

FIGS. 3A–3C show diagrammatically how a cup 1 is obtained by cold flow pressing of a body 3 and FIG. 3D shows a cup 1 obtained by cold flow pressing. Cold flow pressing is a forming method in which the material, in this case an aluminium body 3, is forced to flow out into a restricted space by applying a pressing force to the material. The restricted space is formed by a counterdie 6, which interacts with a mandrel 9 in such a way that a space of the desired shape is formed between these two when they are brought together. The space can be wholly or partly delimited by these two tools 6, 9.

The counterdie 6 refers to the forming tool that externally shapes the blank that is to be worked and the mandrel 9 refers to the forming tool used to give a blank an internal shape in various types of cold forming machines.

In cold flow pressing of a cup 1 according to FIG. 3D for the manufacture of a shell 2 according to the invention, the body 3 can be turned to size if necessary, following which it is provided with a hole 17, for example by drilling a hole 17. The hole 17, which is preferably a through hole, is suitably drilled so that it coincides with the central axis C of the body 3. The body 3 is then annealed and a lubricant applied. With reference to FIG. 3A, the body 3 is shown placed in the counterdie 6, which is done in such a way that a first end surface 4 of the body 3 that is essentially perpendicular to the central axis C of the body 3 is placed facing towards the bottom 7 of the counterdie 6. The inner wall 8 of the counterdie 6 encloses at least a part of the body 3 and preferably the whole body 3, so that the body 3 is hereby placed in the counterdie 6. The mandrel 9 is applied to the end surface 5 of the body 3 lying free. At the front the mandrel 9 is provided with a guide pin 18, which fits into the hole 17 in the centre of the body 3. The guide pin 18 is preferably placed centrally on the mandrel 9 and the guide pin 18 preferably has a cylindrical cross-section. The guide pin 18 interacts with the through hole 17 of the body 3 and a hole 19 in the counterdie 6, so that correct positioning of the body 3 is obtained. This preferably means that the body 3 is centred. The guide pin can be arranged fixedly or movably to interact with the mandrel. The guide pin in FIG. 3A is an example of a fixed guide pin. A movable guide pin is movable in an axial direction inside the mandrel. The guide pin is suitably arranged so that its central axis coincides with the central axis of the mandrel. It is hereby ensured that the quantity of material in the body 3 is distributed symmetrically around the mandrel 9, which gives advantages in production. It is perceived that the through hole 17 of the body 3 and the hole 19 of the counterdie suitably have a shape and dimension that correspond to the shape and dimension of the guide pin 18. A suitable dimension of the guide pin can be in the range of 5–30 mm. It is also perceived that the hole 19 in the counterdie is preferably placed centrally in the bottom of the counterdie 6. When the hole 17 in the body 3 coincides with the central axis C of the body and the guide pin 18 of the mandrel 9 is placed centrally on the mandrel, the advantage is achieved that the mandrel can act symmetrically on the body 3, particularly if the hole 19 of the counterdie is placed centrally in the bottom of the counterdie 6 and the guide pin 18 can also interact with the hole 19 in the counterdie. This gives a symmetrical distribution of the quantity of material around the mandrel 9. It is to be understood that the mandrel 9 preferably has a circular-cylindrical cross-section.

The counterdie 6 surrounds the material both on the underside and to the side and when the mandrel 9 is pressed down in the body 3 the material will flow out towards the sides of the body 3 and gradually be forced upwards into the space formed between the walls 10 and 8 respectively of the mandrel 9 and counterdie 6, so that a cup 1 is formed, which is shown in FIG. 3B. The size of the body 3 is adapted so that a sufficient amount of material is available for production but without the quantity of waste being unnecessarily great. During cold flow pressing, the thickness of the bottom of the cup 1 is reduced and the height of the wall of the cup 1 increases as the mandrel 9 acts on the body 3 when this lies in the counterdie 6. The cold flow pressing is completed when a predetermined height of the wall of the cup 1 and/or a predetermined thickness of the bottom of the cup 1 is obtained, see FIG. 3C. These dimensions depend on a number of parameters and are decided primarily by the required quantity of material being present in the bottom and wall of the cup 1 respectively for the manufacture of a shell 2 that is true to gauge. Another parameter that decides the dimensions of the cup 1 is that it is desirable to attain a predetermined degree of deformation of the finished shell 2. The degree of deformation influences the strength properties of the material through deformation hardening and also has an effect on the hardenability, so that a high degree of deformation gives better hardenability. The cold flow pressing operation in which the body 3 is formed into a cup by the mandrel 9 and the counterdie 6 can be carried out at room temperature, which contributes to a cost-effective procedure.

The degree of deformation is calculated as the ratio between the total area reduction and the original area in a given cross-section. The degree of deformation in cold flow pressing, i.e. production stages 3A–3C, is calculated as (A1–A2)/A1 where A1 is the cross-sectional area of the body that is marked in FIG. 3A and A2 is the cross-sectional area of the cup and is marked in FIG. 3C. The degree of deformation is calculated in the same way in deep drawing and flanging.

The body 3 has a homogeneous material structure in a direction coaxial with the central axis C of the body 3 that coincides with the direction of movement of the mandrel 9. In cold flow pressing a circumferential wall 11 is formed and the homogeneous material structure means that the wall 11 is deformed uniformly, so that an upper open end 12 of the cup 1 acquires an essentially even edge 13 due to the cold flow pressing. The thickness of the wall can also be controlled in a better manner as a result of the homogeneous material structure. With reference to FIG. 3D, a finished cup 1 is shown in which the circumferential wall 11 formed in cold flow pressing in any cross-section perpendicular to the central axis C of the cup 1 has an essentially even material thickness $d_v$ in a range in which $d_v$=1–50 mm, preferably 2–25 mm and even more preferredly 3–10 mm and in which the material thickness $d_v$ is permitted a maximum variation of 1.0 mm, preferably a maximum of 0.5 mm and even more preferredly a maximum of 0.05 mm. The bottom 14 of the cup 1, formed in cold flow pressing by uniform deformation, has a bottom thickness $d_B$ in a range in which $d_B$=1–50 mm, preferably 2–25 mm and even more preferredly 3–10 mm and in which the material thickness $d_B$ is permitted a maximum variation of 1.0 mm, preferably a maximum of 0.5 mm and even more preferredly a maximum of 0.05 mm. Due to the fact that the cup acquires a high dimensional accuracy, no further working needs to be done before the deep drawing, which is a major advantage.

Figures 4A, 4B:
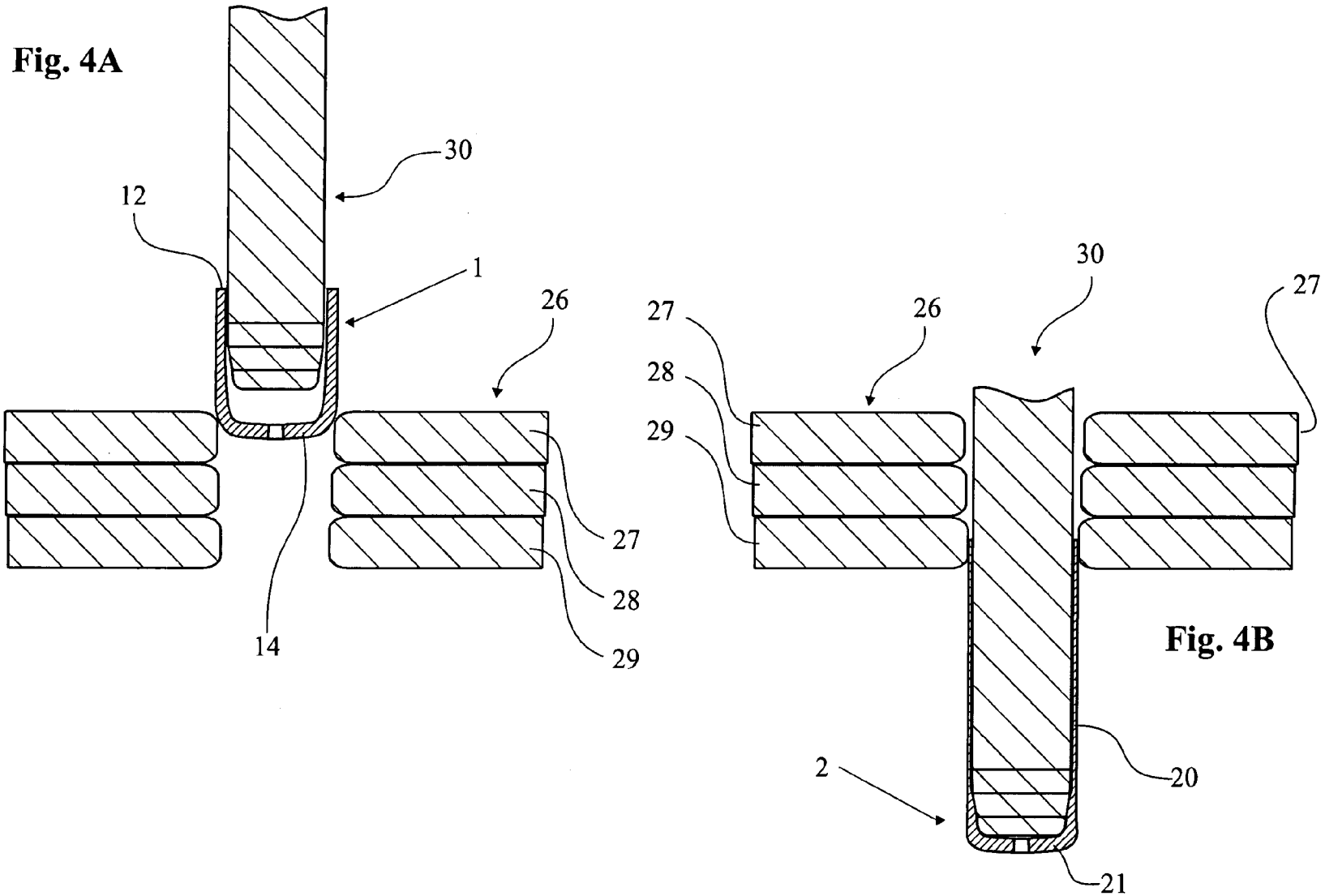
FIGS. 4A–4B show diagrammatically deep drawing of a cup to form a shell.
Figures 4C, 5, 6, 7, 8:
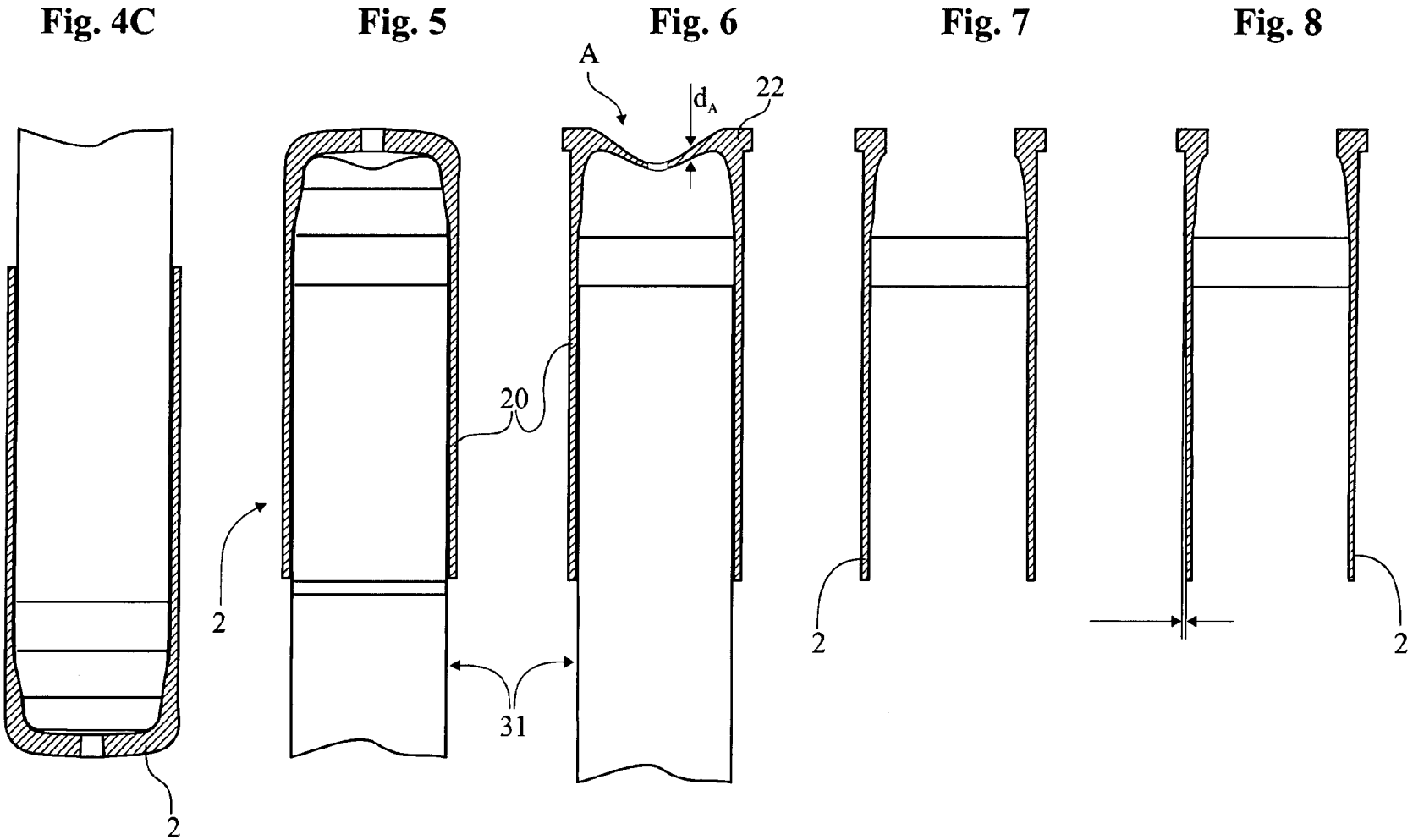
FIG. 4C shows a cross-section of a shell directly following deep drawing.
FIG. 5 shows a cross-section of a shell following cutting to the correct length.
FIG. 6 shows a cross-section of a shell following flanging of the bottom.
FIG. 7 shows a cross-section of a shell following cutting out of the bottom.
FIG. 8 shows a cross-section of a finished shell following drawing.

FIGS. 4A and 4B show schematically how a shell 2 is obtained by deep drawing of a cup 1 and FIG. 4C shows a shell 2 directly following deep drawing. The cold flow pressed cup 1 is washed, annealed and pickled and is thus ready for deep drawing. The deep drawing proceeds such that the cup 1 is placed over a deep drawing counterdie 26, see FIG. 4A, where the deep drawing counterdie 26 has the form of rings 27, 28, 29 placed on top of one another, which have a gradually diminishing diameter and in which the smallest diameter corresponds to the outer dimensions of the finished shell 2. The cup 1 is placed so that the bottom 14 of the cup 1 is over the opening of the deep drawing counterdie 26 and the upper open end 12 of the cup 1 faces away from the deep drawing counterdie 26. A mandrel 30 in the form of a rod is guided down into the cup 1 and when it reaches the bottom 14 it pulls the cup 1 down with it through the deep drawing counterdie 26, see FIG. 4B, due to which the shell wall is thinned out when it passes the gradually diminishing holes in the deep drawing counterdie 26.

The end of the mandrel 30 that is pressed against the bottom 14 of the cup 1 has a shape that gives the wall 20 of the shell a gradually increasing inner diameter from its bottom 21 and upwards in a direction along the wall 20 of the shell. At a suitable distance from the end, the shape of the mandrel 30 passes over to wholly cylindrical, when the diameter corresponds to the inner diameter of the finished shell. To be able to be guided down into the cup 1, the mandrel 30 has a diameter that is 0.1–0.5 mm less than the diameter of the cup 1. During deep drawing the wall will be pressed until it bears on the mandrel 30 due to the effect of the outer deep drawing counterdie 26. Depending on how great a reduction is to be made in the thickness of the wall, the number of stages by which the diameter of the deep drawing counterdie 26 diminishes is varied, so that a large reduction requires more stages than a small one. The composition of the material with regard to the starting blank and its strength properties are also of importance for the number of stages that are required. In manufacture of a shell 2 according to the invention, the homogeneous material structure has a positive effect insofar as the shell wall has the same strength overall. This means that the possibility exists of designing the forming tools with fewer stages, whereby the tool cost is reduced.

Following deep drawing, the wall 20 of the shell 2 is to be cut off at its open end to the correct length. To do this, the shell 2 is placed over a mandrel 31, according to FIG. 5, in a machine that also executes the subsequent working processes up to the finished shell.

When the shell wall has been cut off, flanging of the bottom 21 of the shell 2 follows. In the flanging, a counterdie (not shown) is pressed against the outside of the bottom 21 of the shell 2 and according to the same principle as in cold flow pressing, the mandrel 31 interacts with the counterdie (not shown), the bottom 21 of the shell 2 being formed into a flange 22 with an appearance according to the cross-section in FIG. 6. Since the bottom thickness $d_B$ of the cup 1 can easily be varied in the initial cold flow pressing, it is easy to adapt the quantity of material to different types of flanges.

According to an aspect of the invention, the bottom thickness $d_B$ of the cup 1 is to be chosen so that wear on the tools that are used in flanging is prevented or reduced. In one embodiment of the invention, the bottom thickness $d_B$ is chosen so that it allows the flanging to be executed so that a central part A of the bottom 21 of the shell 2 acquires a thickness $d_A$ in a range in which $d_A$=1 mm–10 mm, preferably 4 mm–6 mm and preferably approx. 5 mm.

Following flanging, cutting out of the remaining material in the central part A of the bottom 21 of the shell 2 takes place and then the shell 2 is washed. FIG. 7 shows a cross-section of a shell 2 following cutting of the bottom.

To give the shell 2 the desired strength properties it is solution heat treated and quenched according to methods that are well known to the expert The shell 2 is given its final form, which is shown in FIG. 8, by a slight drawing of the shell wall. Artificial aging to give the shell 2 the desirable strength, turning, surface treatment and final inspection then take place, the production process thus being completed.

It is also possible to adapt production so that the shell 2 is given the required strength properties only by the plastic deformation that manufacture causes, so that the subsequent solution heat treatment and related artificial aging can be avoided, which offers cost advantages for the production process.

The shell 2 can suitably be used as a shell 2 in the production of ammunition, i.e. grenade shells or cartridge shells and thus high demands are made on the strength of the shell to ensure the function of the shell. A shell manufactured according to the invention has proved to meet these requirements well.

With production according to the invention, production advantages can be obtained. Due to the fact that the mandrel for cold flow pressing is provided with a guide pin 18, a cup 1 can be manufactured that has such dimensional accuracy that no further working is required prior to deep drawing, which also offers cost advantages. In this connection, it is important that the guide pin 18 has such strength that it provides steady guidance. The guide pin 18 cannot therefore be made too small, as it would result in a risk of it bending, with uneven material distribution and poor dimensional accuracy as a result. To obtain sufficient strength, a guide pin 18 designed to be used for manufacture of a shell 2 according to the invention can suitably have a diameter in the range 5–30 mm, preferably 10–30 mm. The expert perceives that the method according to the invention is therefore designed primarily for manufacture of shells with through holes.

As described earlier, the cup 3 is given favourable material properties due to the plastic deformation that cold flow pressing gives rise to. This brings with it the advantage that the later deep drawing from cup 1 to shell 2 can be executed in a single stage. This preferably means that the shell is drawn to its finished length in a single stage. This gives further cost advantages.

As stated earlier, the body 3 can undergo a turning operation following cutting from a bar in order to adjust the diameter of the body 3 to the counterdie 6. However, no machining other than that required to adapt the diameter needs to be carried out. As stated earlier, it is however very advantageous to drill a through hole 17 through the body 3. On cutting the body 3 from a bar, the height of the body 3 is suitably selected so that the height of the body is adapted to the counterdie 6 already on cutting from the bar. However, further plastic working should preferably be avoided, since such working could affect the homogeneous material structure around the central axis C of the body 3.

It is perceived that the invention also relates to equipment for manufacture of a shell 2, which equipment comprises a counterdie 6 such as described above and a mandrel 9 with guide pin 18 such as described above. The equipment according to the invention also comprises a further counterdie 26 for deep drawing as described above, in which the deep drawing counterdie 26 takes the form of rings 27, 28, 29 placed on top of one another, which have a gradually diminishing diameter and in which the smallest diameter corresponds to the outer dimensions of the finished shell 2.

The equipment according to the invention also comprises a mandrel 30 in the form of a rod designed to interact with the deep drawing counterdie 26 in that the mandrel 30 is guided down into the cup 1 and pulls the cup 1 down with it through the deep drawing counterdie 26, due to which the wall 20 of the shell is thinned out when it passes the gradually diminishing holes in the deep drawing counterdie 26. The equipment according to the invention can also comprise means for cutting a bar, for example a metal saw or other cutting device. Furthermore, the equipment according to the invention can comprise means for annealing and pickling as well as means for cutting the shell wall and means for flanging.

ADVANTAGES OF THE INVENTION

Manufacture of shells according to the invention results in a number of advantages, several of which are evident from the description of the figures. In addition to these already stated advantages, the invention also results in the following advantages:

By using a bar material that is cut into the correct lengths, the consumption of raw materials is minimized in the sense that no wastage or very little wastage arises compared with manufacturing shells from rounds, where the rounds are cut from cold-rolled sheet, which results in large amounts of waste. This means that the rounds are relatively expensive to purchase.

Manufacture from a round also requires the cup to be turned at its upper edge, which is not required with manufacture according to the invention, which further reduces wastage.

From the production engineering aspect, it is of course also an advantage if wastage is minimized when producing the raw material, as otherwise large amounts of material are handled and worked unnecessarily, with the energy consumption and environmental pollution this entails.

The homogeneous material structure in the body means that the material flows more uniformly in all directions and a more controlled cup formation is thereby obtained than when a round is used. Due to this, the cup can be manufactured with greater precision of the wall and bottom thickness.

A substantial advantage of the invention is that the bottom thickness can easily be varied. By pressing the mandrel down to a certain depth in the body, a predetermined thickness of the bottom of the cup is obtained. Thus, the thickness is adjusted depending on the quantity of material required for flanging. By adjusting the thickness it is possible to avoid overheating and related wear of the flanging tools as a result of a bottom that is too thin, which is not possible in manufacture from a round.

The expert perceives that with a variable body according to the invention, shells and cylinders can be manufactured with great flexibility as far as the form of the finished product is concerned. It is possible for example to produce open, closed or partly open bottom sections. With cold flow pressing the bottom can be formed with parts projecting in the pressing direction in a number of different shapes, for example cooling flanges, rods and other forms that can then be worked further into, for example, eyes, fastening devices or other things. The shape of the shell wall can also be varied. The outer sheath surface of the wall can be circular or cornered, while the inner can have a completely different shape. A variable body also offers great flexibility during the actual production process, where the final product can be given desirable properties, e.g. desirable strength properties through deformation hardening and desirable hardenability through a degree of reduction.

The homogeneous material structure also gives the advantage that the cup acquires an essentially even upper edge on cold flow pressing and no turning of the edge is therefore required, which is a must when manufacturing from rounds.

Due in particular to the fact that cold flow pressing of a cup from a bar material is combined with subsequent deep drawing from a cup to a shell, an efficient procedure is obtained for manufacturing shells.

The invention claimed is:

1. Method for manufacture of a cup that is designed to serve as a blank in the production of a metal shell, which method comprises the following stages:

a) providing a body of a bar material having a through hole;

b) placing the body in a counterdie so that a first end surface of the body that is substantially perpendicular to the central axis of the body is placed facing towards a bottom of the counterdie while the inner wall of the counterdie encloses at least a part of the body, so that the body is hereby placed in the counterdie, the counterdie having a hole in the bottom;

c) applying a mandrel to a second end surface of the body that is substantially perpendicular to the central axis of the body, in which the mandrel has a centrally placed guide pin for interacting with the through hole of the body and for interacting with the hole in the bottom of the counterdie so that the body is thereby centered in relation to the mandrel and in relation to the counterdie;

d) application of a pressing force to the mandrel, so that the body is cold flow pressed into a cup by plastic deformation, wherein the hole of the counterdie has a shape and dimension that corresponds to a shape and dimension of the guide pin such that the bar material is prevented from flowing between the guide pin and the hole in the counterdie during the application of pressing force to the mandrel.

2. Method according to claim 1, wherein the body has a width or diameter of 10–500 mm and has a height of 5–300 mm.

3. Method according to claim 1, wherein the body has a width or diameter of 30–350 mm and a height of 10–100 mm.

4. Method according to claim 1, wherein the body has a width or diameter of 50–200 mm and a height of 20–50 mm.

5. Method for manufacture according to claim 1, wherein the body forms a part of a bar and has a chiefly homogeneous material structure around the central axis of the bar material.

6. Method according to claim 1, wherein the cold flow pressing a surrounding wall is formed that is deformed uniformly, so that an upper open end of the cup acquires a substantially even edge due to the cold flow pressing and that the surrounding wall formed in cold flow pressing in any cross-section perpendicular to the central axis of the cup has a substantially even material thickness dV in a range in which dV=1–50 mm and in which the material thickness is permitted a maximum variation of 1.0 mm.

7. Method according to claim 6, wherein the dV=2–25 mm.

8. Method according to claim 6, wherein the dV=3–10 mm.

9. Method according to claim 6, wherein the material thickness is permitted a maximum variation of 0.5 mm.

10. Method according to claim 6, wherein the material thickness is permitted a maximum variation of 0.05 mm.

11. Method according to claim 6, wherein the inner wall of the counterdie encloses the whole body.

12. Method according to claim 1, wherein the cold flow pressing a bottom is formed that is deformed uniformly in which the bottom thickness dB=1–50 mm and in which the material thickness is permitted a maximum variation of 1.0 mm.

13. Method according to claim 12, wherein the dB=2–25 mm.

14. Method according to claim 12, wherein the dB=3–10 mm.

15. Method according to claim 12, wherein the material thickness is permitted a maximum variation of 0.5 mm.

16. Method according to claim 12, wherein the material thickness is permitted a maximum variation of 0.05 mm.

17. Method according to claim 12, wherein a central part of the bottom of the shell following flanging has a thickness in the range 1 mm–10mm.

18. Method according to claim 1, wherein said shell is a cartridge shell in which the cartridge shell has a diameter of 10–500 mm and a height of 20–3000 mm and has a minimum wall thickness at the mouth of the shell of 0.5–3.0 mm.

19. Method according to claim 18, wherein the cartridge shell has a diameter of 30–350 mm and a height of 50–2000 mm and has a minimum wall thickness at the mouth of the shell of 1.2–2.0 mm.

20. Method according to claim 18, wherein the cartridge shell has a diameter of 50–200 mm and a height of 100–1000 mm and has a minimum wall thickness at the mouth of the shell of 1.3–1.7 mm.

21. Process for manufacture of a shell, which process comprises the following stages:

a) providing a circular-cylindrical body of a bar material;

b) forming a through hole in the body, which hole coincides with a central axis of the body;

c) placing the body in a counterdie so that a first end surface of the body that is substantially perpendicular to the central axis of the body is turned towards a bottom of the counterdie while the inner wall of the counterdie encloses at least a part of the body so that the body is hereby placed in the counterdie, the counterdie having a centrally located hole in the bottom;

d) applying a mandrel to a second end surface of the body that is substantially perpendicular to the central axis of the body, in which the mandrel has a centrally placed guide pin for interacting with the through hole of the body and the hole in the bottom of the counterdie so that the body is thereby centered in relation to the mandrel and the counterdie;

e) applying a pressing force to the mandrel, so that the body is cold flow pressed into a cup by plastic deformation, wherein the hole of the counterdie has a shape and dimension that corresponds to a shape and dimension of the guide pin such that the bar material is prevented from flowing between the guide pin and hole in the counterdie during the application of pressing force to the mandrel; and f) deep drawing of the cup thus produced so that a shell is formed.

22. Process according to claim 21, wherein the cold flow pressing is terminated when the bottom of the cup has acquired a predetermined thickness in the range 3 mm–10 mm.

23. Process according to claim 21, wherein the shell comprises a grenade shell.

24. Process according to claim 21, wherein the shell comprises a cartridge shell.

25. Process according to claim 21, wherein the through hole is formed by drilling.

* * * * *